US007618128B2

(12) United States Patent
Mataki

(10) Patent No.: US 7,618,128 B2
(45) Date of Patent: Nov. 17, 2009

(54) LIQUID EJECTION HEAD, LIQUID EJECTION APPARATUS, AND DRIVE CONTROL METHOD

(75) Inventor: Hiroshi Mataki, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 345 days.

(21) Appl. No.: 11/190,943

(22) Filed: Jul. 28, 2005

(65) Prior Publication Data

US 2006/0023029 A1 Feb. 2, 2006

(30) Foreign Application Priority Data

Jul. 30, 2004 (JP) ..... 2004-223842

(51) Int. Cl.
*B41J 2/045* (2006.01)

(52) U.S. Cl. ..... 347/68; 347/10; 347/7; 347/11

(58) Field of Classification Search ..... 347/9–11, 347/47, 68, 7
See application file for complete search history.

(56) References Cited

U.S. PATENT DOCUMENTS

| | | | | |
|---|---|---|---|---|
| 5,124,716 | A * | 6/1992 | Roy et al. | 347/11 |
| 5,155,498 | A * | 10/1992 | Roy et al. | 347/11 |
| 5,204,695 | A | 4/1993 | Tokunaga et al. | |
| 6,318,829 | B1 | 11/2001 | Suzuki | |
| 6,494,554 | B1 * | 12/2002 | Ikemoto et al. | 347/10 |
| 6,659,600 | B2 * | 12/2003 | Oda et al. | 347/92 |
| 6,962,398 | B2 * | 11/2005 | Okuda et al. | 347/10 |
| 2002/0027585 | A1 | 3/2002 | Oda et al. | |
| 2004/0056909 | A1 * | 3/2004 | Takahashi et al. | 347/5 |

FOREIGN PATENT DOCUMENTS

| | | | |
|---|---|---|---|
| JP | 64-26454 | A | 1/1989 |
| JP | 11-42775 | A | 2/1999 |
| JP | 2001-334659 | A | 12/2001 |
| JP | 2002-36557 | A | 2/2002 |

* cited by examiner

*Primary Examiner*—Matthew Luu
*Assistant Examiner*—Henok Legesse
(74) *Attorney, Agent, or Firm*—Birch, Stewart, Kolasch & Birch, LLP

(57) ABSTRACT

The liquid ejection head comprises: a nozzle through which liquid is ejected; a pressure chamber which stores the liquid ejected through the nozzle; a pressurizing device which changes a volume of the pressure chamber to apply pressure to the liquid stored in the pressure chamber; and a supply port through which the liquid is supplied to the pressure chamber, wherein the liquid ejection head has a structure such that inertance Mn of the nozzle, liquid resistance Rn of the nozzle, compliance Cn caused by a surface tension of the liquid in the nozzle, inertance Ms of the supply port, and liquid resistance Rn of the supply port satisfy the following inequality:

$$\frac{4\cdot(Mn+Ms)}{Cn} \leq (Rn+Rs)^2,$$

so that oscillation of a meniscus surface located in vicinity of the nozzle is controlled at a time of refill when the liquid is filled in the pressure chamber through the supply port after the liquid is ejected from the nozzle.

2 Claims, 10 Drawing Sheets

LIQUID EJECTION HEAD, LIQUID EJECTION APPARATUS, AND DRIVE CONTROL METHOD

BACKGROUND OF THE INVENTION

1. Field of the Invention

The present invention relates to a liquid ejection head, a liquid ejection apparatus, and a drive controlling method, more particularly to a structure and an ejection control technology of a liquid ejection head which is used in an inkjet recording apparatus and the like.

2. Description of the Related Art

As an example of an image forming apparatus, there is known an inkjet recording apparatus which has an inkjet head (ejection head) having disposed multiple nozzles (ejection elements) therein, and forms an image on a medium (ejection receiving medium) by ejecting ink from the nozzles while relatively moving the inkjet head and the medium.

For an ink ejection method in an inkjet head of an inkjet recording apparatus, there is known a piezoelectric method where a diaphragm (pressure plate) constituting a part of a pressure chamber is deformed by deformation of a piezoelectric element to change the volume of the pressure chamber, ink is introduced from an ink supply path into the pressure chamber when the volume of the pressure chamber is increased, and then the ink inside the pressure chamber is ejected as a droplet from a nozzle when the volume of the pressure chamber is reduced, and also a thermal inkjet method where ink in an ink chamber (pressure chamber) is heated to generate bubbles, and then the ink is ejected with the inflation energy generated when the bubbles grow.

When a pressurizing device, such as a piezoelectric element or a heater, which pressurizes ink ejected from the nozzle, is driven by means of a drive signal according to image data, ejection energy provided to the ink from the pressurizing device is generated. When the ejection energy acts on the ink inside the pressure chamber, the ink is ejected from the nozzle.

In the inkjet recording apparatus, ejection performance of the ink has an influence on the quality of the obtained image and print efficiency. Various efforts are made in an inkjet head in order to realize fast and stable ink ejection. For example, there is proposed a technology for performing fast and stable ejection in which a method for driving a piezoelectric element, which is a pressurizing device for pressurizing ink, is elaborated, when the ink is ejected from an inkjet head by means of the piezoelectric method.

Japanese Patent Application Publication No. 64-26454 discloses an inkjet recording apparatus, in which, after the main pulse for ejecting the ink is generated, a sub pulse with a power value that is less than or equal to the main pulse is generated to reduce the oscillation of the meniscus. In this inkjet recording apparatus, it is possible to eliminate the oscillation of the meniscus, which occurs in the vicinity of the orifice that leads to the liquid path, prevent incorporation of bubbles and leakage of the ink from the ejection port at times other than when the liquid path is driven, and obtain a constantly stable and favorable record image.

Japanese Patent Application Publication No. 11-42775 discloses an inkjet recording apparatus and ink ejection controlling method, in which, in the ink ejection cycles where the volume of the ink storage chamber is reduced in the ejection stages to eject the ink from the nozzles after increasing the volume of the ink storage chamber in the supply stages, when the volume of the ink storage chamber is reduced to a second value in the ejection stages after the volume of the ink storage chamber is increased to a first value in the supply stages, the volume of the ink storage chamber is maintained in a third value, which is between the first value and the second value, in the subsequent stage of the ejection stages, and then reduced to the second value. In such an inkjet recording apparatus and ink ejection controlling method, disturbance of the ink in the ejection stages can be prevented, so that the ink can be supplied smoothly in the subsequent cycle.

In the inkjet recording apparatus described in Japanese Patent Application Publication No. 64-26454, and in the inkjet recording apparatus and ink ejection controlling method described in Japanese Patent Application Publication No. 11-42775, the object is to control oscillation of the meniscus surface. These are effective particularly when using ink having low viscosity, but if the viscosity of the ink becomes high, oscillation of the meniscus surface becomes low, whereby the meniscus does not oscillate enough to affect ejection, thus it becomes no longer necessary to control the oscillation of the meniscus surface.

However, if the viscosity of the ink becomes high, the refill time (time for supplying ink into the pressure chamber) increases significantly due to the effect of viscosity resistance. Since the time for waiting until refilling is completed becomes long, this time for waiting is the rate-controlling factor, thus the problem is that the ejection speed (ejection frequency) is lowered.

SUMMARY OF THE INVENTION

The present invention has been contrived in view of such circumstances, and the object thereof is to provide a liquid ejection head, a liquid ejection apparatus, and a drive control method that can maintain an ejection frequency without lowering the refill speed even when using highly viscous liquid, and are preferred especially when using highly viscous liquid.

In order to attain the aforementioned object, the present invention is directed to a liquid ejection head, comprising: a nozzle through which liquid is ejected; a pressure chamber which stores the liquid ejected through the nozzle; a pressurizing device which changes a volume of the pressure chamber to apply pressure to the liquid stored in the pressure chamber; and a supply port through which the liquid is supplied to the pressure chamber, wherein the liquid ejection head has a structure such that inertance Mn of the nozzle, liquid resistance Rn of the nozzle, compliance Cn caused by a surface tension of the liquid in the nozzle, inertance Ms of the supply port, and liquid resistance Rn of the supply port satisfy the following inequality:

$$\frac{4\cdot(Mn+Ms)}{Cn} \leq (Rn+Rs)^2,$$

so that oscillation of a meniscus surface located in vicinity of the nozzle is controlled at a time of refill when the liquid is filled in the pressure chamber through the supply port after the liquid is ejected from the nozzle.

According to the present invention, in the case of refilling where the liquid is filled in the pressure chamber through the supply port after the liquid is ejected from the nozzle, the relationship among the inertance Mn of the nozzle, the liquid resistance Rn of the nozzle, the compliance Cn caused by the surface tension of the liquid in the nozzle, the inertance Ms of the supply port, and the liquid resistance Rn of the supply port is determined so as to control oscillation of the meniscus located in the vicinity of the nozzle, thus a predetermined ejection frequency can be maintained without increasing the refill time.

The nozzle mentioned here has an opening portion and a conduit portion, which is communicated to the opening portion, and the conduit portion may be structured so as to be configured by a plurality of conduit portions.

As a configuration example of the ejection head, a full line type head with columns of nozzles having disposed therein a plurality of nozzles for ink ejection across the full width of an ejection receiving medium.

In this case, a mode may be adopted in which a plurality of relatively short ejection head blocks having nozzles rows which do not reach a length corresponding to the full width of the ejection receiving medium are combined and joined together, thereby forming nozzle rows of a length corresponding to the full width of the ejection receiving medium.

A full line type head is usually disposed in a direction perpendicular to the relative feed direction (relative conveyance direction) of the ejection receiving medium, and modes may also be adopted in which the inkjet head is disposed following an oblique direction that forms a prescribed angle with respect to the direction perpendicular to the relative conveyance direction.

"Ejection head" includes the one called "inkjet head" or "print head" used in an image forming apparatus such as an inkjet recording apparatus.

A pressurizing device has an electromechanical transducer for changing an electric signal to pressure. As the electromechanical transducer there is an actuator for generating a deformation corresponding to a drive signal. Further, the actuator is configured so as to have an electrostriction element and a diaphragm which is displaced according to a distortion of the electrostriction element.

"Nozzle" mentioned here can include a conduit portion, an opening portion or a groove, which has a restriction function on the ejection side.

For liquid which is ejected from the nozzle, there is ink used in an inkjet recording apparatus, processing liquid, chemical liquid, water and the like, which is deposited on a medium by means of an application apparatus such as a dispenser.

For example, the liquid has a viscosity of at least $5.5\times10^{-3}$ Pa·s.

When using highly viscous liquid having a viscosity higher than the liquid that is used generally, the refill time is sometimes increased significantly due to an impact of a viscosity resistance. The present invention is effective particularly when using such highly viscous liquid.

In order to attain the aforementioned object, the present invention is also directed to a liquid ejection apparatus, comprising: the above-described liquid ejection; and a drive controlling device which drives the pressurizing device so as to increase the volume of the pressure chamber more than the volume of an initial state thereof before starting an ejection operation for a predetermined period of time after the liquid is ejected through the nozzle, and to return the volume of the pressure chamber to the initial state after the predetermined period of time elapses.

According to the present invention, in the case of refilling where the liquid is filled in the pressure chamber through the supply port after the liquid is ejected from the nozzle, the volume of the pressure chamber is controlled so as to be increased, thus the refill speed can be increased by using force which is generated by the pressurizing device at the time of refill. In particularly, when using highly viscous liquid having a large liquid resistance, a predetermined refill time can be maintained. Furthermore, when using the force generated by the pressurizing device, oscillation of the meniscus can be controlled, whereby the refill speed can be increased.

In a drive controlling device, there is a configuration that has a drive signal generating device which generates a drive signal provided to the pressurizing device.

Preferably, the drive controlling device performs control so as to return the volume of the pressure chamber to the initial state when the liquid of at least a volume of the liquid ejected through the nozzle is supplied to the pressure chamber through the supply port.

If a period of time for increasing the size of the pressure chamber becomes long, an ejection cycle becomes long. Then, the period of time for increasing the volume of the pressure chamber more than that in the initial state (in other words, the predetermined period of time) is preferably the same as a period of time until liquid in substantially the same amount as ejected liquid is supplied to the pressure chamber through the supply port.

Preferably, a volume ΔV which is obtained when increasing the volume of the pressure chamber from the initial state thereof before starting the ejection operation for the predetermined period of time after the liquid is ejected through the nozzle, satisfies the following inequality:

$$\Delta V \leq \frac{2}{3}\cdot\pi\cdot r^3,$$

where r is a radius of the nozzle.

More specifically, the upper limit of the volume variation ΔV obtained when expanding the pressure chamber after the liquid ejection is determined such that the liquid is not ejected from the nozzle when the pressurizing device is driven at the time when the volume of the pressure chamber is returned to the initial state.

In order to attain the aforementioned object, the present invention is also directed to a drive control method, comprising: an ejection step of changing a volume of a pressure chamber by driving a pressurizing device to eject liquid stored in the pressure chamber through a nozzle; a pressure chamber expanding step of driving the pressurizing device to increase the volume of the pressure chamber more than the volume of an initial state thereof before starting the ejection step for a predetermined period of time after the ejection step; and a pressure chamber returning step of driving the pressurizing device to return the volume of the pressure chamber which is increased in the pressure chamber expanding step to the volume of the initial state after the predetermined period of time elapses.

The drive signal which is used in the ejection step has a mode in which the pressurizing device is driven in a direction of either a pushing direction or a pulling direction to eject the liquid, or a mode in which the pressurizing device is driven continuously in the pushing direction and pulling direction such that the pressurizing device is subjected to push-pull drive, to eject the liquid.

Preferably, in the drive control method, the above-described liquid ejection head is used.

According to the present invention, in the case of refilling where liquid is supplied to the pressure chamber through the supply port after the liquid is ejected from the nozzle, the relationship among the inertance Mn of the nozzle, the liquid resistance Rn of the nozzle, the compliance Cn caused by the surface tension of the liquid inside the nozzle, the inertance Ms of the supply port, and the liquid resistance Rn of the supply port is determined so that the meniscus surface located in the vicinity of the nozzle does not oscillate, thus a predetermined ejection frequency can be maintained without increasing the refill time.

Moreover, the volume of the pressure chamber is increased more than its initial state of before an ejection operation, and the pressurizing device is controlled so as to return the volume of the pressure chamber to the volume of its initial state after a lapse of a predetermined time. Therefore, the refill time is not increased significantly due to an impact of the viscosity resistance when using highly viscous liquid, and a predetermined ejection cycle can be secured.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

General Composition of Inkjet Recording Apparatus

Figure 1:
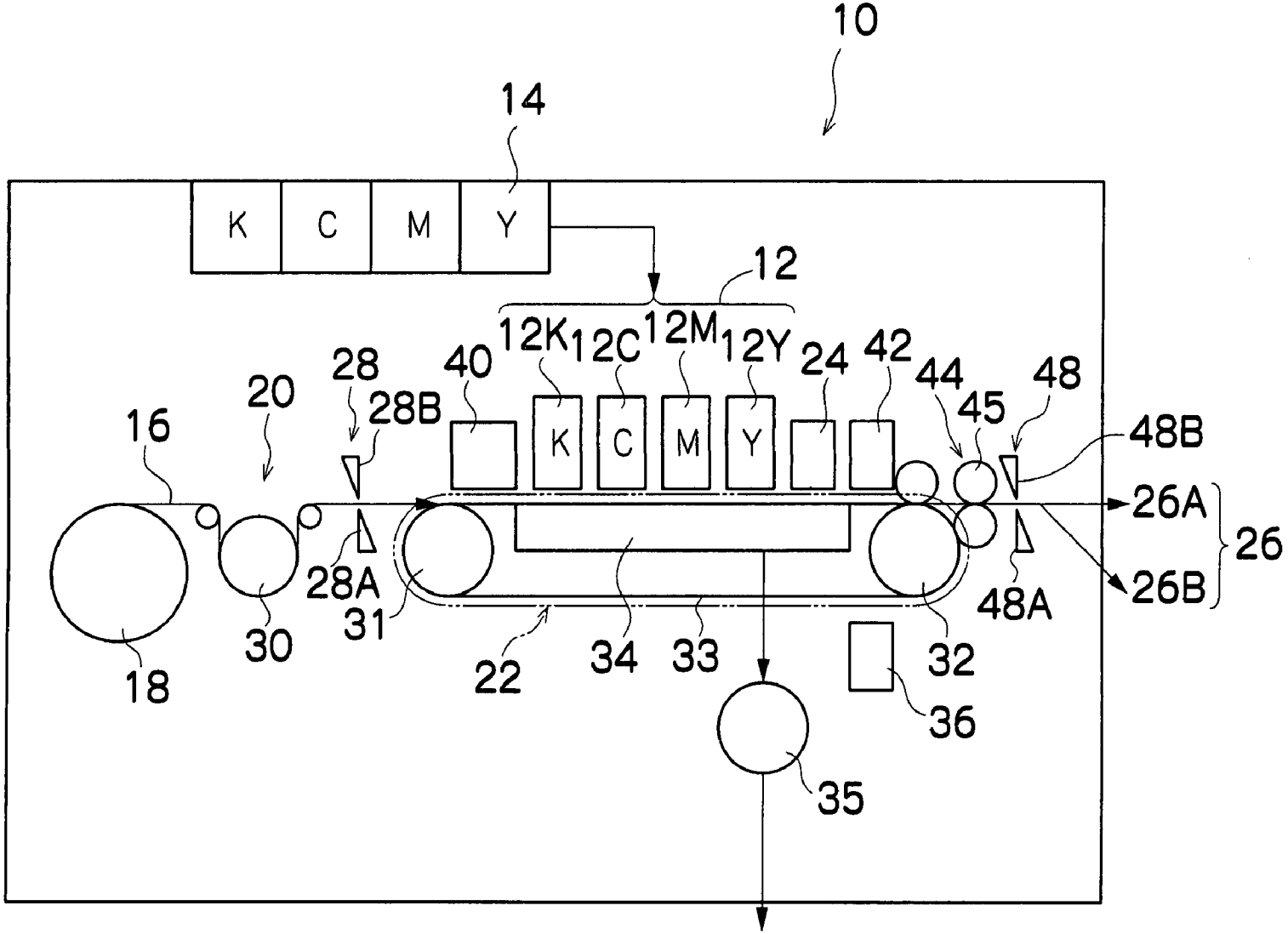
FIG. 1 is an entire configuration diagram of an inkjet recording apparatus in which is used an image processing apparatus according to an embodiment of the present invention.

FIG. 1 is a diagram of the general composition of an inkjet recording apparatus according to an embodiment of the present invention. As shown in FIG. 1, the inkjet recording apparatus 10 comprises: a printing unit 12 having a plurality of inkjet heads 12K, 12C, 12M and 12Y provided for ink colors of black (K), cyan (C), magenta (M) and yellow (Y), respectively; an ink storing and loading unit 14 for storing inks of K, C, M and Y to be supplied to the print heads 12K, 12C, 12M and 12Y; a paper supply unit 18 for supplying recording paper 16; a decurling unit 20 removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper. (printed matter) to the exterior.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of recording medium to be used (type of medium) is automatically determined, and ink-droplet ejection is controlled so that the ink-droplets are ejected in an appropriate manner in accordance with the type of medium.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut papers are used, the cutter 28 is not required.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1. The suction chamber 34 provides suction with a fan 35 to generate a negative pressure, and the recording paper 16 is held on the belt 33 by suction.

The belt 33 is driven in the clockwise direction in FIG. 1 by the motive force of a motor 88 (not shown in FIG. 1, but shown in FIG. 7) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there might be a problem in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
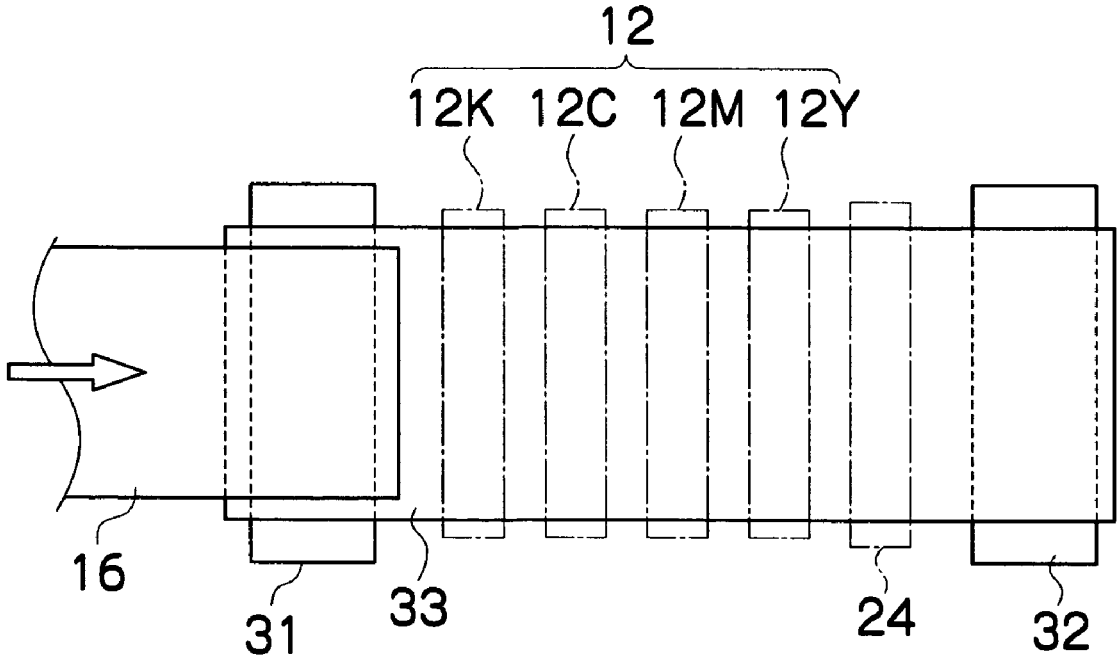
FIG. 2 is a plan view of a principal component around a print unit of the inkjet recording apparatus shown in FIG. 1.

The print unit 12 is a so-called "full line head" in which a line head having a length corresponding to the maximum paper width is arranged in a direction (main scanning direction) that is perpendicular to the conveyance direction of the recording paper (sub-scanning direction) (see FIG. 2). An example of the detailed structure is described below with reference to FIGS. 3A to 5, and each of the print heads 12K, 12C, 12M, and 12Y is constituted by a line head, in which a plurality of ink ejection ports (nozzles) are arranged along a length that exceeds at least one side of the maximum-size recording paper 16 intended for use in the inkjet recording apparatus 10, as shown in FIG. 2.

The print heads 12K, 12C, 12M, and 12Y are arranged in the order of black (K), cyan (C), magenta (M), and yellow (Y) from the upstream side, following the feed direction of the recording paper 16 (hereinafter, referred to as the sub-scanning direction). A color print can be formed on the recording paper 16 by ejecting the inks from the print heads 12K, 12C, 12M, and 12Y, respectively, onto the recording paper 16 while conveying the recording paper 16.

The print unit 12, in which the full-line heads covering the entire width (the entire width of the printable region) of the paper are thus provided for the respective ink colors, can record an image over the entire surface of the recording paper 16 by performing the action of moving the recording paper 16 and the print unit 12 relatively to each other in the sub-scanning direction just once (in other words, by means of a single sub-scan). Higher-speed printing is thereby made possible and productivity can be improved in comparison with a shuttle type head configuration in which a print head moves reciprocally in the main scanning direction.

Although a configuration with four standard colors, K, M, C and Y, is described in the present embodiment, the combinations of the ink colors and the number of colors are not limited to these, and light and/or dark inks can be added as required. For example, a configuration is possible in which print heads for ejecting light-colored inks such as light cyan and light magenta are added.

As shown in FIG. 1, the ink storing and loading unit 14 has tanks for storing inks of the colors corresponding to the respective print heads 12K, 12C, 12M and 12Y, and each tank is connected to a respective print head 12K, 12C, 12M or 12Y, via a tube channel (not illustrated). The ink storing and loading unit 14 also comprises a warning device (for example, a display device or an alarm sound generator) for warning when the remaining amount of any ink is low, and has a mechanism for preventing loading errors among the colors.

The print determination unit 24 shown in FIG. 1 has an image sensor for capturing an image of the ink-droplet deposition result of the printing unit 12, and functions as a device to check for ejection defects such as clogs of the nozzles in the printing unit 12 from the ink-droplet deposition results evaluated through the image sensor.

The print determination unit 24 of the present embodiment is configured with at least a line sensor having rows of photoelectric transducing elements with a width that is greater than the ink-droplet ejection width (image recording width) of the heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

A test pattern or the target image printed by the print heads 12K, 12C, 12M, and 12Y of the respective colors is read in by the print determination unit 24, and the ejection performed by each head is determined. The ejection determination includes detection of the ejection, measurement of the dot size, and measurement of the dot formation position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, the paper output unit 26A for the target prints is provided with a sorter for collecting prints according to print orders.

Structure of the Head

Next, the structure of a print head will be described. The print heads 12K, 12C, 12M and 12Y provided for the respective ink colors have the same structure, and a reference numeral 50 is hereinafter designated to any of the print heads 12K, 12C, 12M and 12Y.

Figure 3A:
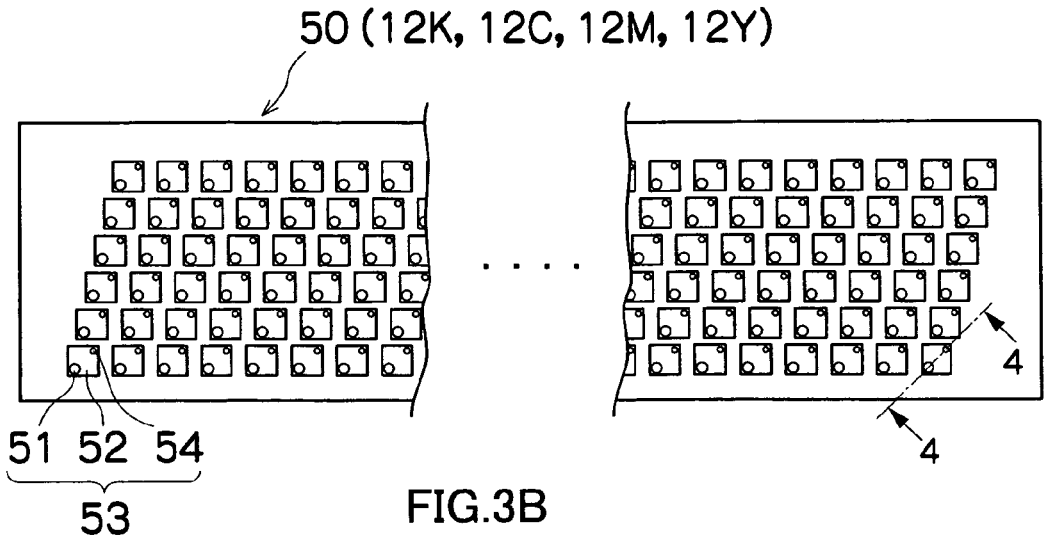
FIGS. 3A to 3C are plan perspective views showing a head of the inkjet recording apparatus shown in FIG. 1.
Figure 3B:
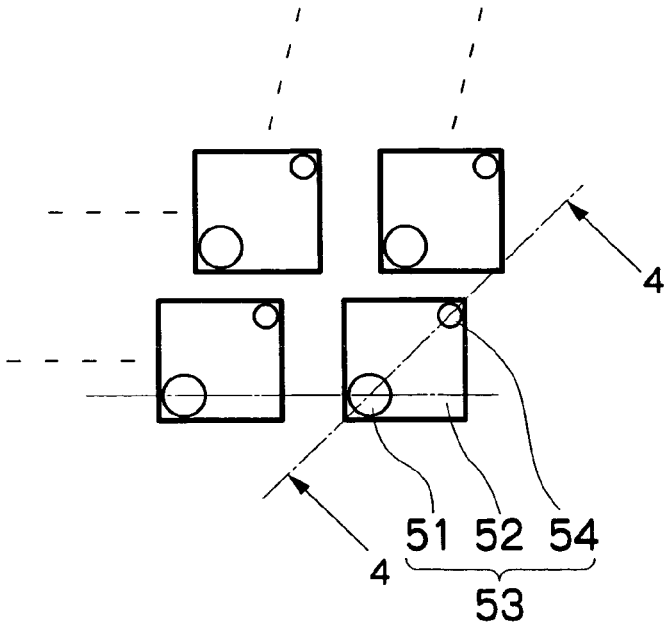
Figure 3C:
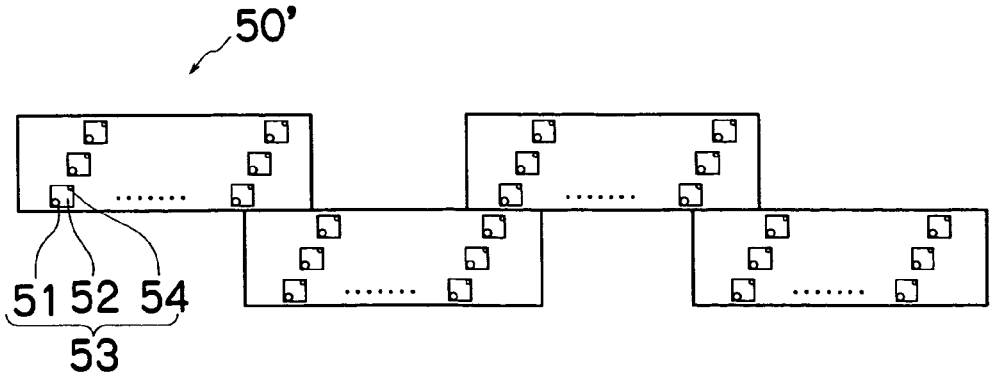
Figure 4:
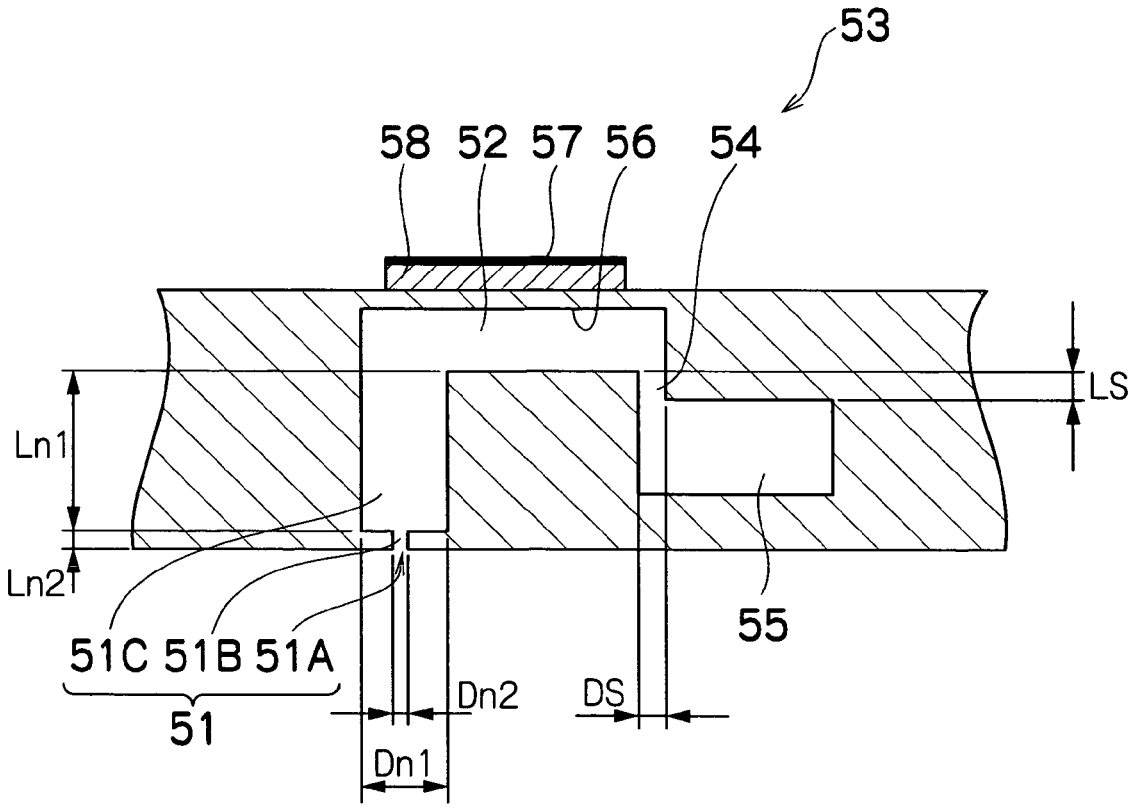
FIG. 4 is a sectional drawing showing an inner structure of the head shown in FIGS. 3A to 3C.

FIG. 3A is a plan view perspective diagram showing an example of the structure of a print head 50, and FIG. 3B is an enlarged diagram of a portion of same. Furthermore, FIG. 3C is a plan view perspective diagram showing a further example of the composition of a print head 50, and FIG. 4 is a cross-sectional diagram showing a three-dimensional composition of an ink chamber unit (being a cross-sectional view along line 4-4 in FIG. 3A). In order to achieve a high density of the dot pitch printed onto the surface of the recording medium, it is necessary to achieve a high density of the nozzle pitch in the print head 50. As shown in FIGS. 3A to 3C and FIG. 4, the print head 50 in the present embodiment has a structure in which a plurality of ink chamber units 53 (ejection elements), each comprising nozzles 51 for ejecting ink droplets and pressure chambers 52 corresponding to the nozzles 51, are disposed in the form of a staggered matrix, and the effective nozzle pitch is thereby made small.

More specifically, as shown in FIGS. 3A and 3B, the print head 50 according to the present embodiment is a full-line head having one or more nozzle rows in which a plurality of nozzles 51 for ejecting ink are arranged along a length corresponding to the entire width of the recording medium in a direction substantially perpendicular to the conveyance direction of the recording medium.

Moreover, as shown in FIG. 3C, it is also possible to use respective heads 50' of nozzles arranged to a short length in a two-dimensional fashion, and to combine same in a zigzag arrangement, whereby a length corresponding to the full width of the print medium is achieved.

The pressure chamber 52 provided corresponding to each of the nozzles 51 is approximately square-shaped in plan view, and the nozzle 51 and a supply port 54 are provided respectively at either corner on a diagonal of the pressure chamber 52. Each pressure chamber 52 is connected via the supply port 54 to the common flow passage 55.

An actuator (pressuring device) 58 provided with an individual electrode 57 is bonded to a pressure plate 56 (a diaphragm that also serves as a common electrode), which forms the ceiling of the pressure chamber 52. When a drive voltage is applied to the individual electrode 57, the actuator 58 is deformed, the volume of the pressure chamber 52 is thereby changed, and the pressure in the pressure chamber 52 is thereby changed, so that the ink inside the pressure chamber 52 is thus ejected through the nozzle 51. The actuator 58 is preferably a piezoelectric element. When ink is ejected, new ink is supplied to the pressure chamber 52 from the common flow channel 55 through the supply port 54.

In the ink chamber units 53, the shapes, sizes and the like for the nozzles 51 and the supply port 54 are optimized so as to satisfy conditions that the refill time is not increased significantly when using highly viscous ink having a viscosity higher than commonly used ink. The detail of these configurations is described later.

As shown in FIG. 4, the nozzle 51 of the present embodiment has a nozzle narrow-conduit portion 51B with a narrow diameter, which is located in the vicinity of an opening portion 51A, and a nozzle broad-conduit portion 51C, which has a diameter broader than the nozzle narrow-conduit portion 51B and is located between the nozzle narrow-conduit portion 51B and the pressure chamber 52.

Among the reference numerals shown in FIG. 4, Ln1 represents the length of the nozzle broad-conduit portion 51C, Ln2 represents the length of the nozzle narrow-conduit portion 5B, and Ls represents the length of the supply port 54. Moreover, Dn1 represents the diameter of the nozzle broad-conduit portion 51C, Dn2 represents the diameter of the nozzle narrow-conduit portion 51B, and Ds represents the diameter of the supply port 54.

The nozzle narrow-conduit portion 51B has an even diameter in FIG. 4; however, it is possible that the nozzle narrow-conduit portion 51B has a tapered structure where the diameter of the nozzle narrow-conduit portion 51B is reduced at a constant rate from the pressure chamber 52 side towards the opening portion 51A side. The diameter Dn2 of the nozzle narrow-conduit portion 51B in this case may be the average value of the tapered shape portion. Moreover, the diameters of the nozzle narrow-conduit portion 51B and the nozzle broad-conduit portion 51C may be the same. Furthermore, there may also be provided another conduit portion having a diameter different from the diameters of the nozzle narrow-conduit portion 51B and the nozzle broad-conduit portion 51C.

In the present description, the opening portion 51A or the narrow-conduit portion 51B is sometimes called simply "nozzle 51". Also, the part from the opening portion 51A through the broad-conduit portion 51C is sometimes called collectively "nozzle 51".

In the present embodiment, the "supply port 54" includes not only the opening portion on the supply system side of the pressure chamber 52, but also a flow path (conduit) having a restriction function on the ink supply side.

More specifically, the nozzle 51 and the supply port 54 represent flow paths such as an opening portion, conduit, channel or the like having the restriction functions on the ejection side and supply side, and liquid resistance and inertance are calculated in accordance with the flow paths. The flow path with the restriction function may be configured to have a plurality of flow paths, or may be a part of one flow path.

Figure 5:
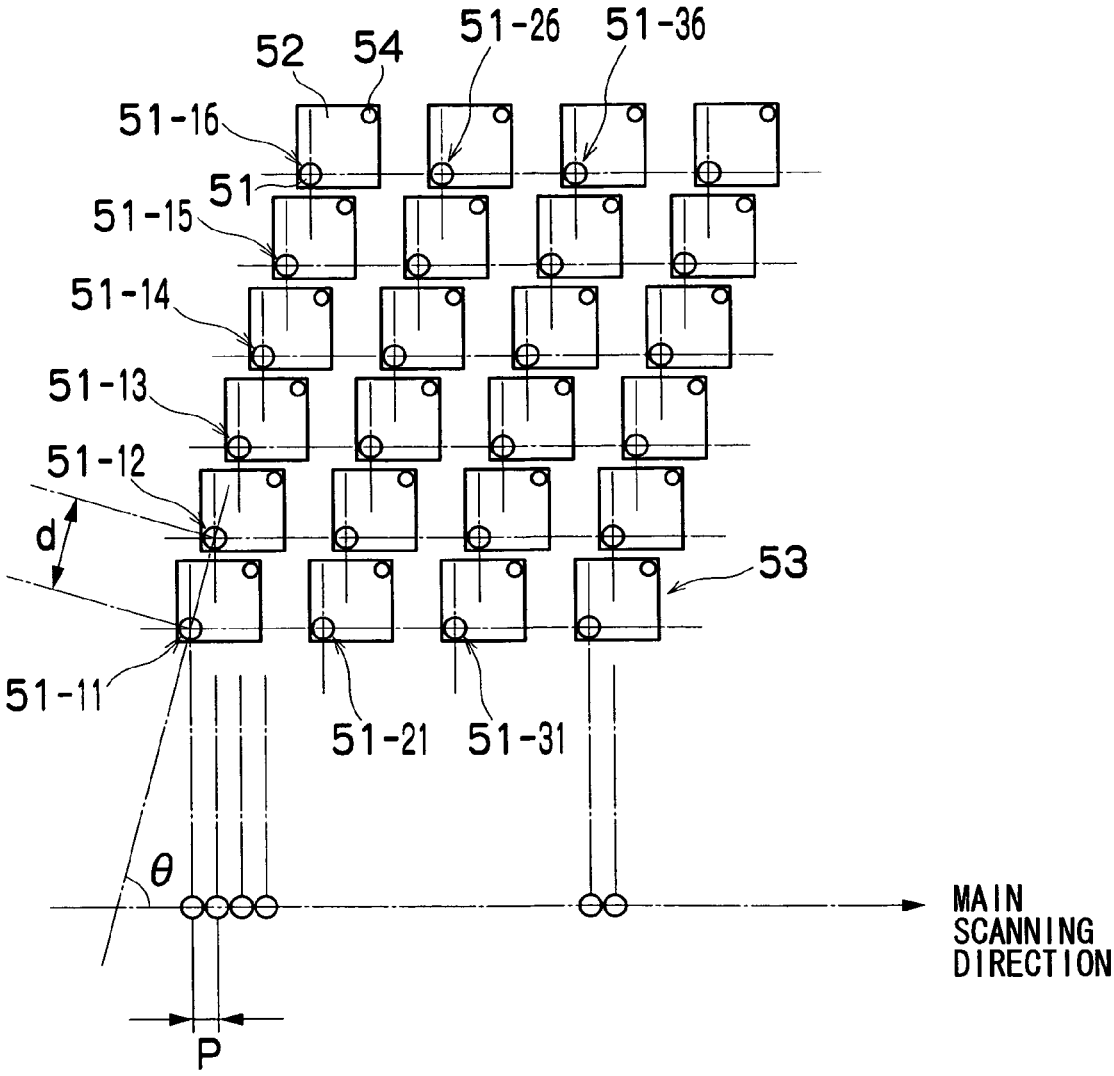
FIG. 5 is an enlarged drawing showing an arrangement of nozzles of the head shown in FIGS. 3A to 3C.

As shown in FIG. 5, the plurality of ink chamber units 53 having this structure are composed in a lattice arrangement, based on a fixed arrangement pattern having a row direction which coincides with the main scanning direction, and a column direction which, rather than being perpendicular to the main scanning direction, is inclined at a fixed angle of $\theta$ with respect to the main scanning direction. By adopting a structure wherein a plurality of ink chamber units 53 are arranged at a uniform pitch d in a direction having an angle $\theta$ with respect to the main scanning direction, the pitch P of the nozzles when projected to an alignment in the main scanning direction will be $d \times \cos\theta$.

More specifically, the arrangement can be treated equivalently to one wherein the respective nozzles 51 are arranged in a linear fashion at uniform pitch P, in the main scanning direction. By means of this composition, it is possible to achieve a nozzle composition of high density, wherein the nozzle columns projected to an alignment in the main scanning direction reach a total of 2400 per inch (2400 nozzles per inch). Below, in order to facilitate the description, it is supposed that the nozzles 51 are arranged in a linear fashion at a uniform pitch (P), in the longitudinal direction of the head (main scanning direction).

In a full-line head comprising rows of nozzles corresponding to the entire width of the image recordable width, the "main scanning" is defined as printing a line formed of a row of dots, or a line formed of a plurality of rows of dots in the breadthways direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other.

In particular, when the nozzles 51 arranged in a matrix such as that shown in FIG. 5 are driven, the main scanning according to the above-described (3) is preferred. More specifically, the nozzles 51-11, 51-12, 51-13, 51-14, 51-15 and 51-16 are treated as a block (additionally; the nozzles 51-21, 51-22, . . . , 51-26 are treated as another block; the nozzles 51-31, 51-32, . . . , 51-36 are treated as another block; . . . ); and one line is printed in the width direction of the recording paper 16 by sequentially driving the nozzles 51-11, 51-12, . . . , 51-16 in accordance with the conveyance velocity of the recording paper 16.

On the other hand, "sub-scanning" is defined as to repeatedly perform printing of a line formed of a row of dots, or a line formed of a plurality of rows of dots, formed by the main scanning, while moving the full-line head and the recording paper relatively to each other.

The arrangement of the nozzles is not limited to the illustrated examples in the embodiments of the present invention, thus an arrangement in which the nozzles are lined up in a column direction along the main scanning direction and a row direction along the sub-scanning direction, and other various nozzle arrangements can be applied.

Further, in the present embodiment, a single-layer piezoelectric element having one piezoelectric body layer is exemplified; however, the present invention can also be applied to a multilayer piezoelectric element in which two or more piezoelectric body layers are stacked.

The pressure plate 56 also serves as the common electrode in the present embodiment; however, it is possible that the pressure plate 56 and the common electrode are provided separately, and an insulating layer is provided between the pressure plate 56 and the common electrode when using a conducting material, such as a metallic material, for the pressure plate 56.

Configuration of Ink Supply System

Figure 6:
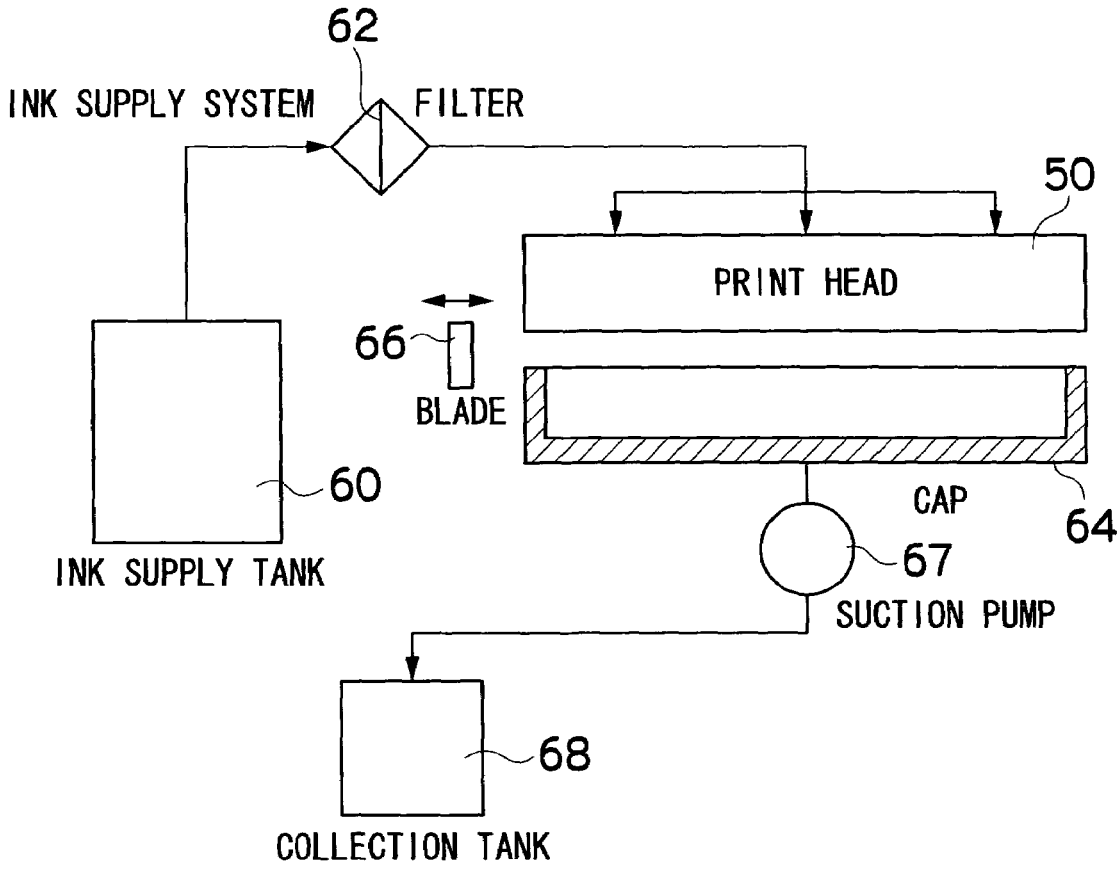
FIG. 6 is a schematic drawing showing a configuration of an ink supply system in the inkjet recording apparatus.

FIG. 6 is a schematic drawing showing the configuration of the ink supply system in the inkjet recording apparatus 10.

The ink tank 60 is a base tank that supplies ink to the head 50 and is set in the ink storing and loading unit 14 described with reference to FIG. 1. The aspects of the ink tank 60 include a refillable type and a cartridge type: when the remaining ink amount is low, the ink tank 60 of the refillable type is filled with ink through a filling port (not shown) and the ink tank 60 of the cartridge type is replaced with a new one. In order to change the ink type in accordance with the intended application, the cartridge type is suitable, and it is preferable to represent the ink type information with a bar code or the like on the cartridge, and to perform ejection control in accordance with the ink type. The ink tank 60 in FIG. 6 is equivalent to the ink storing and loading unit 14 in FIG. 1 described above.

A filter 62 for removing foreign matters and bubbles is disposed between the ink tank 60 and the head 50 as shown in FIG. 6. The filter mesh size in the filter 62 is preferably equivalent to or less than the diameter of the nozzle and commonly about 20 μm. Although not shown in FIG. 6, it is preferable to provide a sub-tank integrally to the print head 50 or nearby the head 50. The sub-tank has a damper function for preventing variation in the internal pressure of the head and a function for improving refilling of the print head.

The inkjet recording apparatus 10 is also provided with a cap 64 as a device to prevent the nozzles 51 from drying out or to prevent an increase in the ink viscosity in the vicinity of the nozzles 51, and a cleaning blade 66 as a device to clean the nozzle face. A maintenance unit including the cap 64 and the cleaning blade 66 can be relatively moved with respect to the head 50 by a movement mechanism (not shown), and is moved from a predetermined holding position to a maintenance position below the head 50 as required.

The cap 64 is displaced up and down relatively with respect to the head 50 by an elevator mechanism (not shown). When the power of the inkjet recording apparatus 10 is turned OFF or when in a print standby state, the cap 64 is raised to a predetermined elevated position so as to come into close contact with the head 50, and the nozzle face is thereby covered with the cap 64.

The cleaning blade 66 is composed of rubber or another elastic member, and can slide on the ink ejection surface (surface of the nozzle plate) of the head 50 by means of a blade movement mechanism (not shown). When ink droplets or foreign matter has adhered to the nozzle plate, the surface of the nozzle plate is wiped and cleaned by sliding the cleaning blade 66 on the nozzle plate.

During printing or standby, when the frequency of use of specific nozzles is reduced and ink viscosity increases in the vicinity of the nozzles, a preliminary discharge is made to eject the degraded ink toward the cap 64.

Also, when bubbles have become intermixed in the ink inside the head 50 (inside the pressure chamber 52), the cap 64 is placed on the head 50, the ink inside the pressure chamber 52 (the ink in which bubbles have become intermixed) is removed by suction with a suction pump 67, and the suction-removed ink is sent to a collection tank 68. This suction action entails the suctioning of degraded ink whose viscosity has increased (hardened) also when initially loaded into the head 50, or when service has started after a long period of being stopped.

When a state in which ink is not ejected from the head 50 continues for a certain amount of time or longer, the ink solvent in the vicinity of the nozzles 51 evaporates and ink viscosity increases. In such a state, ink can no longer be ejected from the nozzle 51 even if the piezoelectric element 58 for the ejection driving is operated. Before reaching such a state (in a viscosity range that allows ejection by the operation of the piezoelectric element 58) the piezoelectric element 58 is operated to perform the preliminary discharge to eject the ink whose viscosity has increased in the vicinity of the nozzle toward the ink receptor. After the nozzle surface is cleaned by a wiper such as the cleaning blade 66 provided as the cleaning device for the nozzle face, a preliminary discharge is also carried out in order to prevent the foreign matter from becoming mixed inside the nozzles 51 by the wiper sliding operation. The preliminary discharge is also referred to as "dummy discharge", "purge", "liquid discharge", and so on.

When bubbles have become intermixed in the nozzle 51 or the pressure chamber 52, or when the ink viscosity inside the nozzle 51 has increased over a certain level, ink can no longer be ejected by the preliminary discharge, and a suctioning action is carried out as follows.

More specifically, when bubbles have become intermixed in the ink inside the nozzle 51 and the pressure chamber 52, ink can no longer be ejected from the nozzle 51 even if the piezoelectric element 58 is operated. Also, when the ink viscosity inside the nozzle 51 has increased over a certain level, ink can no longer be ejected from the nozzle 51 even if the piezoelectric element 58 is operated. In these cases, a suctioning device to remove the ink inside the pressure chamber 52 by suction with a suction pump, or the like, is placed on the nozzle face of the head 50, and the ink in which bubbles have become intermixed or the ink whose viscosity has increased is removed by suction.

However, since this suction action is performed with respect to all the ink in the pressure chambers 52, the amount of ink consumption is considerable. Therefore, a preferred aspect is one in which a preliminary discharge is performed when the increase in the viscosity of the ink is small.

Description of Control System

Figure 7:
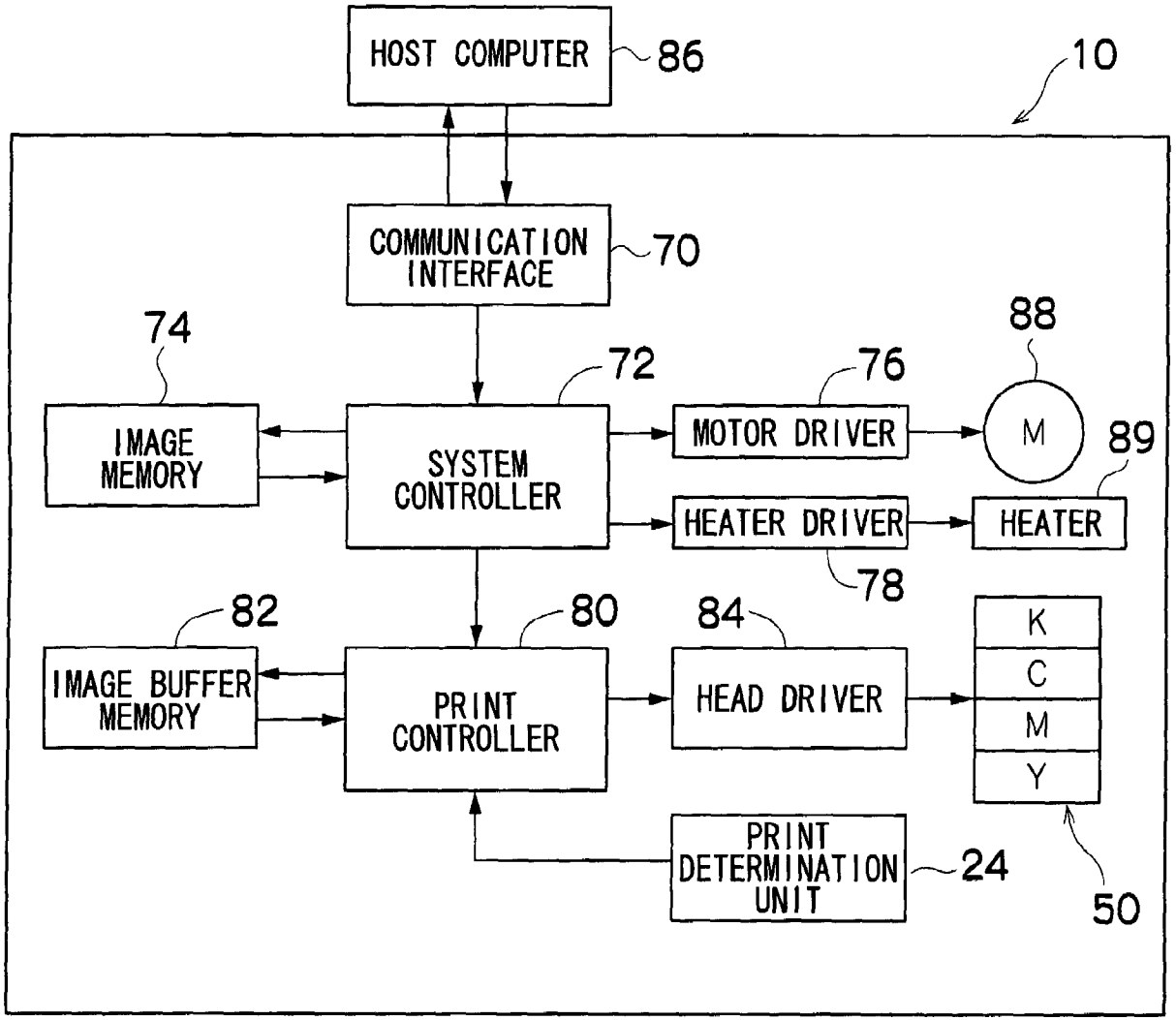
FIG. 7 is a block diagram showing principal components in a system configuration of the inkjet recording apparatus.

FIG. 7 is a principal block diagram showing the system configuration of the inkjet recording apparatus 10. The inkjet recording apparatus 10 comprises a communication interface 70, a system controller 72, an image memory 74, a motor driver 76, a heater driver 78, a print controller 80, an image buffer memory 82, a head driver 84, and the like.

The communication interface 70 is an interface unit for receiving image data sent from a host computer 86. A serial interface such as USB, IEEE1394, Ethernet, wireless network, or a parallel interface such as a Centronics interface may be used as the communication interface 70. A buffer memory (not shown) may be mounted in this portion in order to increase the communication speed.

The image data sent from the host computer 86 is received by the inkjet recording apparatus 10 through the communication interface 70, and is temporarily stored in the image memory 74. The image memory 74 is a storage device for temporarily storing images inputted through the communication interface 70, and data is written and read to and from the image memory 74 through the system controller 72. The image memory 74 is not limited to a memory composed of semiconductor elements, and a hard disk drive or another magnetic medium may be used.

The system controller 72 is constituted by a central processing unit (CPU) and peripheral circuits thereof, and the like, and it functions as a control device for controlling the whole of the inkjet recording apparatus 10 in accordance with a prescribed program, as well as a calculation device for performing various calculations. More specifically, the system controller 72 controls the various sections, such as the communication interface 70, image memory 74, motor driver 76, heater driver 78, and the like, as well as controlling communications with the host computer 86 and writing and reading to and from the image memory 74, and it also generates control signals for controlling the motor 88 and heater 89 of the conveyance system.

The program executed by the CPU of the system controller 72 and the various types of data which are required for control procedures are stored in the image memory 74. The image memory 74 may be a non-writeable storage device, or it may be a rewriteable storage device, such as an EEPROM. The image memory 74 is used as a temporary storage region for the image data, and it is also used as a program development region and a calculation work region for the CPU.

The motor driver (drive circuit) 76 drives the motor 88 in accordance with commands from the system controller 72. The heater driver (drive circuit) 78 drives the heater 89 of the post-drying unit 42 or the like in accordance with commands from the system controller 72.

The print controller 80 has a signal processing function for performing various tasks, compensations, and other types of processing for generating print control signals from the image data stored in the image memory 74 in accordance with commands from the system controller 72 so as to supply the generated print data (dot data) to the head driver 84. Prescribed signal processing is carried out in the print controller 80, and the ejection amount and the ejection timing of the ink droplets from the respective print heads 50 are controlled via the head driver 84, on the basis of the print data. By this means, prescribed dot size and dot positions can be achieved.

The print controller 80 is provided with the image buffer memory 82; and image data, parameters, and other data are temporarily stored in the image buffer memory 82 when image data is processed in the print controller 80. The aspect shown in FIG. 7 is one in which the image buffer memory 82 accompanies the print controller 80; however, the image memory 74 may also serve as the image buffer memory 82. Also possible is an aspect in which the print controller 80 and the system controller 72 are integrated to form a single processor.

The head driver 84 drives the piezoelectric elements 58 of the heads of the respective colors 12K, 12C, 12M and 12Y on the basis of print data supplied by the print controller 80. The head driver 84 can be provided with a feedback control system for maintaining constant drive conditions for the print heads.

The image data to be printed is externally inputted through the communication interface 70, and is stored in the image memory 74. In this stage, the RGB image data is stored in the image memory 74.

The image data stored in the image memory 74 is sent to the print controller 80 through the system controller 72, and is converted to the dot data for each ink color in the print controller 80. In other words, the print controller 80 performs processing for converting the inputted RGB image data into dot data for four colors, K, C, M and Y. The dot data generated by the print controller 80 is stored in the image buffer memory 82.

Various control programs are stored in a program storage unit (not shown), and the control programs are read and executed in accordance with a command of the system controller 72. For the program storage unit, a semiconductor memory such as a ROM or EEPROM may be used, or a magnetic disk may be used. The program storage may have an external interface and use a memory card or a PC card. Of course the program storage unit may have a plurality of storage media of these storage media.

The program storage unit may be used along with a storage device (not shown) such as an operation parameter.

The print determination unit 24 is a block that includes the line sensor as described above with reference to FIG. 1, reads the image printed on the recording paper 16, determines the print conditions (presence of the ejection, variation in the dot formation, and the like) by performing desired signal processing, or the like, and provides the determination results of the print conditions to the print controller 80.

According to requirements, the print controller 80 makes various corrections with respect to the head 50 on the basis of information obtained from the print determination unit 24.

In the embodiment shown in FIG. 1, the configuration is such that the print determination unit 24 is provided on the print surface side, and the print surface is illuminated by a light source (not shown) such as a cold-cathode tube disposed in the vicinity of the line sensor, and the reflected light is read by means of the line sensor. However, other configurations may be possible for the embodiments of the present invention.

Drive Control of the Actuator

Next, drive control of the actuator 58 used in the inkjet recording apparatus 10 is now described in detail.

Figure 8A:
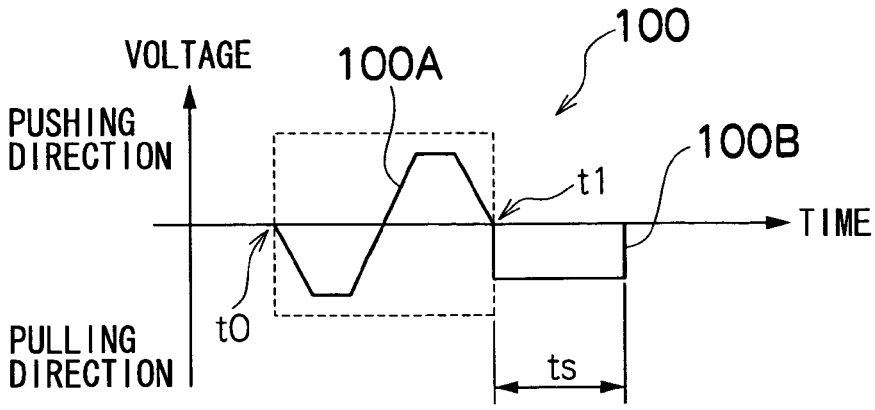
FIGS. 8A to 8C are drawings for explaining drive signals of the head shown in FIGS. 3A to 3C.
Figure 8B:
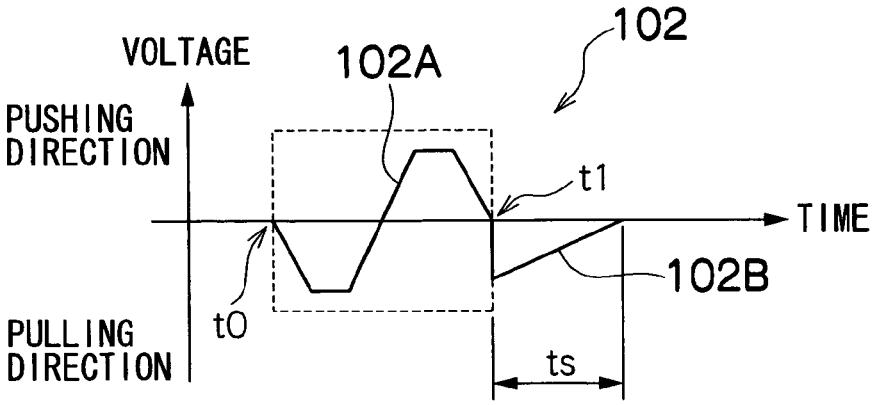
Figure 8C:
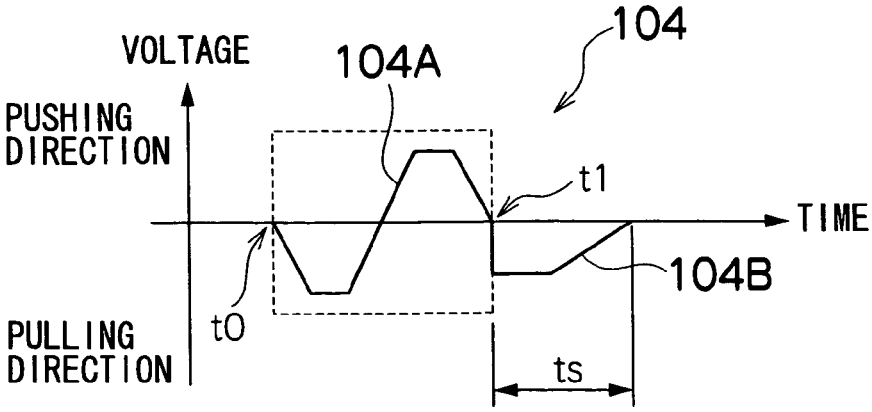

FIG. 8A shows an example of a drive signal (driving wave) 100 applied to the actuator 58, FIG. 8B shows a drive signal 102, which is a modified example of the drive signal 100, and FIG. 8C shows a drive signal 104, which is another modified example of the drive signal 100.

In FIGS. 8A through 8C, the horizontal axis shows time, and the vertical axis shows voltage. Further, the upward direction of the vertical axis indicates a pushing direction, in which the volume of the pressure chamber 52 shown in FIG. 4 is contracted, and the downward direction of the vertical axis indicates a pulling direction, in which the volume of the pressure chamber 52 is increased (expanded).

When the drive signal is 0V, the pressure chamber 52 is not contracted or expanded and is in the initial state (meniscus static state). It is also possible that the drive signal is set to have an offset so that, when a voltage other than 0V is applied, the pressure chamber 52 is in the initial state.

In the inkjet recording apparatus 10, after a drive signal (ejection drive signal) 100A for causing ink ejection is used to perform ink ejection (i.e., ejection step), the size (volume) of the pressure chamber 52 is increased (i.e., pressure chamber expanding step) more than the size in the initial state before an ejection operation is started, and the pressure chamber 52 is controlled such that a refill drive signal 100B is applied for operating the actuator 58 so that the pressure chamber 52 is brought back (i.e., pressure chamber returning step) to the initial state before the ejection operation is started after a predetermined time ts elapses.

The drive signal for ink ejection here indicates parts enclosed in the broken lines in FIGS. 8A through 8C (denoted with the reference numerals 100A, 102A, 104A), and means a drive signal for ejecting the ink, and further operating the actuator 58 until oscillation of the meniscus surface, which is caused by resonance of the nozzle 51 and the pressure chamber 52 and the like, becomes suppressed after the ink is ejected.

The refill drive signals 100B, 102B, 104B are the drive signals for operating the actuator 58 such that the meniscus does not oscillate when refilling ink, in order to reduce the refill time. The details of the refill drive signals are described later.

In a mode shown in FIG. 8A, the ejection drive signal 100A is applied to the actuator 58 during a period between a timing t0 (operation start timing of the actuator 58) and a timing t1 (ink ejection timing), and, after the ink is ejected, in the refill period in which the ink is filled into the pressure chamber 52 from the supply system, which is constituted by the ink supply tank shown in FIG. 6 and the supply flow path (not shown), the refill drive signal 100B is applied to the actuator 58 so as to operate the actuator 58 in the direction of expanding the pressure chamber 52, during the period between the timing t1 to a refill drive voltage application time ts.

The moving speed of the actuator 58 when returning the pressure chamber 52 to the initial state is preferably small so that the ink is not ejected when returning the pressure chamber 52 to the initial state after applying the refill drive signal to expand the pressure chamber 52. This can be done by reducing the voltage variation per unit time of the refill drive signal (reducing the inclination of the voltage wave).

Therefore, the refill drive signal is more preferably of the mode indicated by the reference numeral 102B in FIG. 8B, in which the voltage is decreased gradually, or the mode indicated by the reference numeral 104B in FIG. 8C, in which the voltage is decreased gradually after maintaining a certain voltage for a period of time shorter than ts.

FIGS. 8A through 8C show the drive signals 100, 102, 104 for operating the actuator 58 from the initial state in the order from the pulling direction to the pushing direction to eject the ink, using the ejection drive signals 100A, 102A, 104A having trapezoid waveforms (here, the ejection drive signal 100A, 102A, 104A have the same wave form). It is also possible to apply the drive signals shown in FIGS. 9A through 9D, in which same or like reference numerals as those in FIGS. 8A through 8C are given, and the explanations thereof are omitted. FIGS. 8A through 8C and 9A through 9D show that at timing t1, which is the end of ink ejection timing that begins at timing t0 and the beginning of the refill drive voltage application time ts, the drive signal voltage immediately changes to a predetermined voltage level that is different from the voltage level at the end of ink ejection timing and the refill drive voltage application time ts begins at this predetermined voltage level.

Figure 9A:
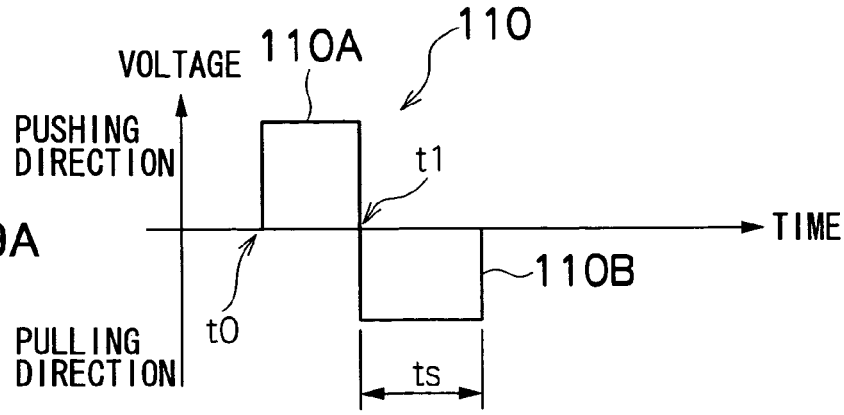
FIGS. 9A to 9D are drawings showing another mode of the drive signals shown in FIGS. 8A to 8C.

FIG. 9A shows a drive signal 110 for operating the actuator 58 in the pushing direction to eject the ink. The drive signal 110 has an ejection drive signal 110A and a refill drive signal 110B. When the drive signal 110 is applied to the actuator 58, the actuator 58 is operated during the period between the timing t0 and timing t1 in the pushing direction so as to eject the ink, the actuator 58 is then operated during the period ts from the timing t1 in the pulling direction so that the volume of the pressure chamber 52 becomes larger compared to the time of ejection and also larger compared to the initial state, thereafter the volume of the pressure chamber 52 returns to the initial state when the period ts elapses after the timing t1.

Figure 9B:
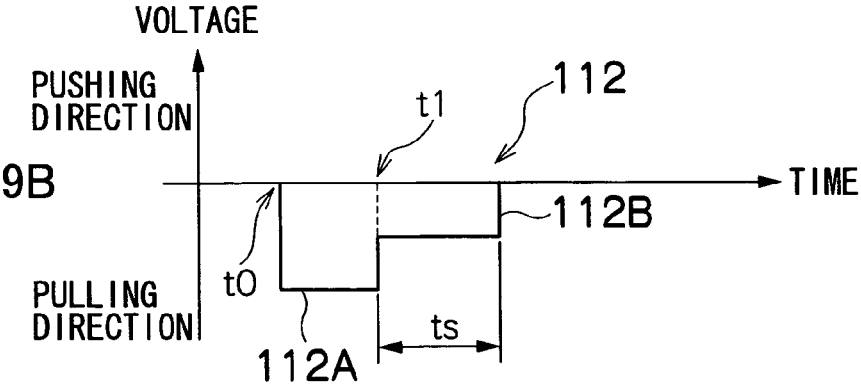

Similarly, FIG. 9B shows a drive signal 112 for operating the actuator 58 in the pulling direction to eject the ink. When the drive signal 112 is applied to the actuator 58, the actuator 58 is operated during the period between the timing t0 and timing t1 in the pulling direction and then in the pushing direction so as to eject the ink, and the actuator 58 is then operated during the period ts from the timing t1 in the pushing direction so that the volume of the pressure chamber 52 is still larger than its initial state.

Figure 9C:
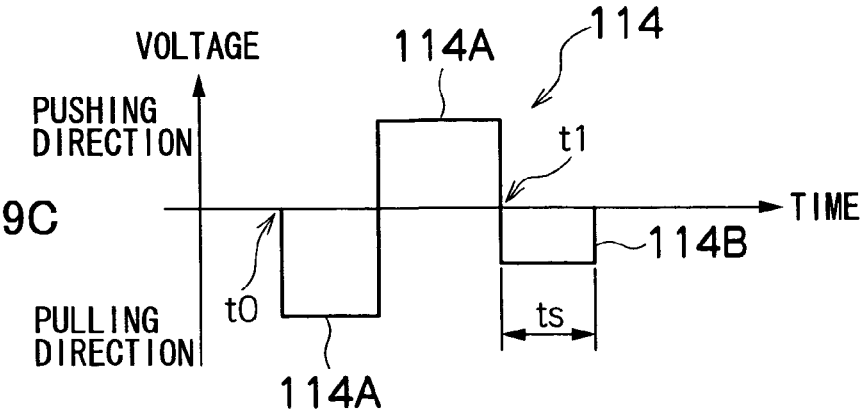

Moreover, FIG. 9C shows a drive signal 114 for operating the actuator 58 in the order from the pulling direction to pushing direction to eject the ink. When the drive signal 114 is applied to the actuator 58, the actuator 58 is operated during the period between the timing t0 and timing t1 in the order from the pulling direction to then in the pushing direction so as to eject the ink, and the actuator 58 is then operated during the period ts from the timing t1 in the pulling direction so as to expand the pressure chamber 52. The drive signal 114 shown in FIG. 9C is obtained by changing the trapezoid waveforms of the ejection drive signal 100A of the drive signal 100 shown in FIG. 8A to square waveforms.

Figure 9D:
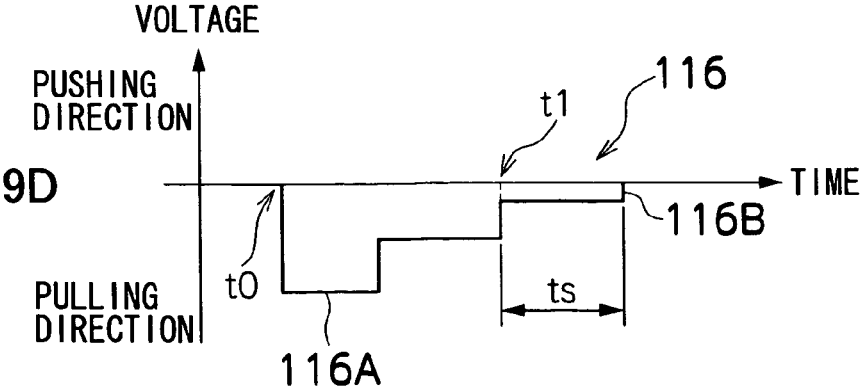

FIG. 9D shows another mode of the drive signals shown in FIGS. 9A through 9C. When applying a drive signal 116 shown in FIG. 9D, the actuator 58 is operated in the pulling direction and thereafter operated in the pushing direction by steps.

More specifically, the drive signal 116 has an ejection drive signal 116A for first operating the actuator 58 in the pulling direction to expand the pressure chamber 52, and then, from this state, operating the actuator 58 in the pushing direction so that the displacement volume of the pressure chamber 52 becomes smaller than that when the actuator is operated in the pulling direction, so as to eject the ink, and a refill drive signal 116B for operating the actuator 58 in the pushing direction so as to obtain a displacement amount between the displacement at the time of ink ejection and the initial state (zero displacement).

In this manner, by operating the actuator 58 at the time of refill such that the pressure chamber 52 is expanded, the speed of supplying the ink at the time of refill can be increased. Moreover, a predetermined supply speed can be maintained also when using highly viscous ink having a large liquid resistance.

On the other hand, the meniscus may be oscillated by operating the actuator 58 when even using the highly viscous ink, whereby the refill time may be increased due to such meniscus oscillation. Therefore, it is necessary to control the meniscus oscillation.

Structure of the Ink Chamber Unit

Next, conditions where the meniscus surface does not oscillate at the time of refill as described above is now described in detail.

Figure 10:
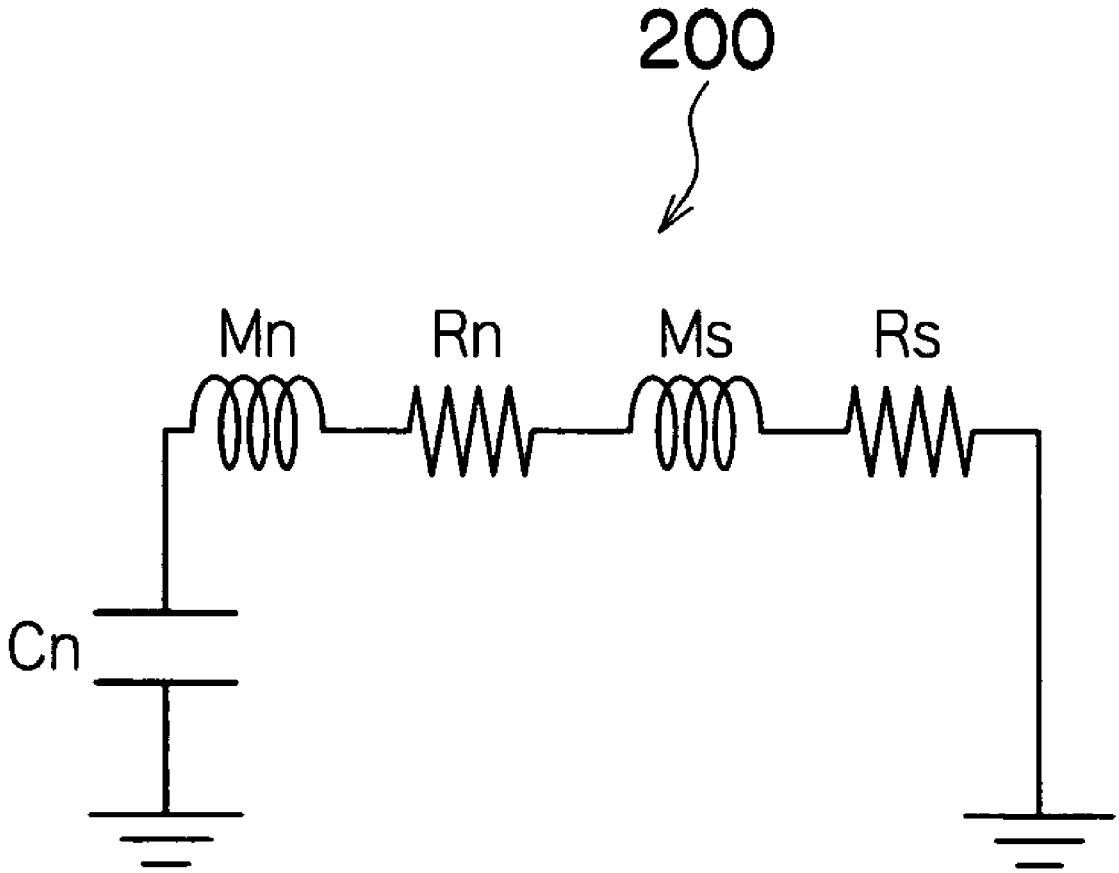
FIG. 10 is a drawing showing a lumped-constant model of the head shown in FIGS. 3A to 3C.

FIG. 10 shows a lumped-constant model (lumped-constant circuit) 200 for representing the function of the ink chamber unit 53 shown in FIG. 4 with an electric circuit.

In the lumped-constant model 200 shown in FIG. 10, $M_n$ represents inertance of the nozzle 51, $R_n$ represents liquid resistance of the nozzle 51, $C_n$ represents compliance caused by the surface tension of the ink at the nozzle part, $M_s$ represents inertance of the supply port 54, and $R_s$ represents liquid resistance of the supply port 54.

The lumped-constant model 200 at the time of refill can be expressed in the following differential equation (1):

$$(M_n + M_s)\frac{d^2v}{dt^2} + (R_n + R_s)\frac{dv}{dt} + \frac{1}{C_n}v = 0, \tag{1}$$

where v is a volume velocity of the ink on the nozzle surface (the nozzle opening portion 51A).

Here, the inertance $M_n$ of the nozzle 51, the resistance $R_n$ of the nozzle 51, the compliance $C_n$ caused by the surface tension of the ink at the nozzle 51, the inertance $M_s$ of the supply port 54, and the resistance $R_s$ of the supply port 54 are expressed in the following formulas (2) through (6):

$$M_n = \rho\cdot\left(\frac{L_{n1}}{A_{n1}} + \frac{L_{n2}}{A_{n2}}\right); \tag{2}$$

$$R_n = 8\cdot\pi\cdot\nu\cdot\left(\frac{L_{n1}}{A_{n1}^2} + \frac{L_{n2}}{A_{n2}^2}\right); \tag{3}$$

$$C_n = \frac{\pi\cdot r_{n2}^4}{3\cdot\sigma}; \tag{4}$$

$$M_s = \rho\cdot\frac{L_s}{A_s}; \text{ and} \tag{5}$$

$$R_s = 8\cdot\pi\cdot\nu\cdot\frac{L_s}{A_s^2}, \tag{6}$$

where ρ is the ink density, ν is the ink viscosity, σ is the surface tension of the ink, $L_{n1}$ is the length of the nozzle broad-conduit portion 51C, $A_{n1}$ is the area of the nozzle broad-conduit portion 51C, $r_{n1}$ is the radius of the nozzle broad-conduit portion 51C (=$D_{n1}/2$), $L_{n2}$ is the length of the nozzle narrow-conduit portion 51B, $A_{n2}$ is the area of the nozzle narrow-conduit portion 51B, $r_{n2}$ is the radius of the nozzle narrow-conduit portion 51B (=$D_{n2}/2$), $L_s$ is the length of the supply port 54, and $A_s$ is the area of the supply port 54.

In the lumped-constant model 200 shown in FIG. 10, a condition where no meniscus oscillation occurs at the time of refill is represented in the following inequality (7) using the above formulas (2) through (6):

$$\frac{4\cdot(M_n + M_s)}{C_n} \le (R_n + R_s)^2. \tag{7}$$

The conditions satisfying the inequality (7) correspond to cases in which the solution of the differential equation (1) is not a damped oscillation solution.

Among the conditions shown in the inequality (7), it is preferable that the value on the right-hand side ($(R_n+R_s)^2$) and the value on the left-hand side $$\left(\frac{4\cdot(M_n + M_s)}{C_n}\right)$$

become close to each other (in other words, when the inequality sign approaches the equality sign), since the speed of refill is increased. A more preferable mode is such that the values on the right-hand side and the left-hand side are equal to each other as follows:

$$\frac{4\cdot(M_n + M_s)}{C_n} = (R_n + R_s)^2. \tag{8}$$

The conditions shown in (7) or (8) can be established with highly viscous ink having a viscosity of at least $5.5\times10^{-3}$ Pa·s (5.5 cP) in a print head generally used in an inkjet recording apparatus.

An example of the above-described general condition of a print head, there is a print head is such that the size of the pressure chamber 52 is 700 μm×700 μm×150 μm, the diameter of the nozzle 51 (the diameter $D_{n2}$ of the nozzle narrow-conduit portion 51B) is 30 μm, the length of the nozzle 51 (the length $L_{n2}$ of the nozzle narrow-conduit portion 51B) is 40 μm, the size of the supply port 54 is a square of 40 μm×40 μm, and the length $L_s$ of the supply port 54 is 100 μm (where the flow resistance and the inertance of the supply port are substantially the same with those of the nozzle).

Therefore, if the viscosity of the ink is $5.5\times10^{-3}$ Pa·s and a general print head as described above is used, the conditions of (7) or (8) are satisfied.

Explanation for Refill Time

Next, the refill drive signal application time ts is now described in detail.

In order to obtain the time required for refill (the refill drive signal application time) ts based on the lumped-constant model 200 shown in FIG. 10 of the ink chamber unit 53, the above-described differential equation (1) is used.

The differential equation (1) is solved for v, which is a volume velocity of the ink on the nozzle surface (the nozzle opening portion 51A), while applying the initial condition where v=0 when t=0, and the ink volume velocity v on the nozzle surface is then shown in the following formula (9):

$$v = v_0\cdot\left(\exp\left(-\frac{1}{2}\cdot\alpha\cdot t\right) - \exp\left(-\frac{1}{2}\cdot\beta\cdot t\right)\right), \tag{9}$$

where $v_0$ is the volume velocity of the ink on the nozzle surface when t=0, and $$\alpha = \frac{R_n + R_s}{M_n + M_s} - \sqrt{\left(\frac{R_n + R_s}{M_n + M_s}\right)^2 - \left(\frac{4}{(M_n + M_s)\cdot C_n}\right)}, \tag{10}$$

-continued $$\beta = \frac{R_n + R_s}{M_n + M_s} + \sqrt{\left(\frac{R_n + R_s}{M_n + M_s}\right)^2 - \left(\frac{4}{(M_n + M_s)\cdot C_n}\right)}. \tag{11}$$

According to the thus obtained ink volume velocity v on the nozzle surface, when obtaining the displacement volume x of the ink (where the ejection direction corresponds to the plus direction, and the refill direction corresponds to the minus direction) on the nozzle surface when the volume of the ink at the time of completion of refill (in other words, in a state where refill of the ink into the pressure chamber 52 is completed, and the ink to be ejected next is stored) is zero, the solution can be expressed in the following formula (12):

$$x = \frac{F}{\sqrt{C_n^2\cdot(R_n + R_s)^2 - 4\cdot(M_n + M_s)\cdot C_n}}\cdot \left(\frac{\exp\left(-\frac{1}{2}\cdot\alpha\cdot t\right)}{-\frac{1}{2}\cdot\alpha} - \frac{\exp\left(-\frac{1}{2}\cdot\beta\cdot t\right)}{-\frac{1}{2}\cdot\beta}\right), \tag{12}$$

where F is the amount (volume) of the ink filled into the pressure chamber 52 at the time of refill, and x=−F when t=0.

Here, when an amount of the ink that is ejected when an ejection operation is performed once is A, and the volume of the pressure chamber 52 that is expanded more than its initial state after the ink is ejected (the volume of the pressure chamber 52 when the refill drive signal is applied) is B, then the amount of ink that is refilled once is expressed as A+B, and the time tA (refill time) until the ink amount A that is required for the next ejection is refilled satisfies a condition expressed in the following formula (13):

$$\frac{x(t = tA)}{x(t = 0)} = \frac{A}{A + B}. \tag{13}$$

Then, the formula (13) can be rewritten as the following formula (14):

$$\frac{A}{A + B} = \frac{\alpha\cdot\exp\left(\frac{1}{2}\cdot\beta\cdot tA\right) - \beta\cdot\exp\left(\frac{1}{2}\cdot\alpha\cdot tA\right)}{\alpha - \beta}. \tag{14}$$

By keeping the state where the pressure chamber 52 is expanded for a period of time that is longer than the refill time tA for satisfying the formula (14), when returning the pressure chamber 52 to its initial state thereafter, the ink amount A required for the next ejection is filled in the pressure chamber 52, whereby refill is completed.

Hence, the refill drive signal application time ts is set to satisfy the following inequality (15):

$$ts > tA. \tag{15}$$

By making the refill drive signal application time ts longer than the refill time tA that satisfies the formula (14), the ink amount necessary for the next ejection can be filled in the pressure chamber 52. However, if the refill drive signal application time ts is made longer, then the ejection cycle is also made longer. Hence, it is preferred that the drive signal application time ts be made short as much as possible. Therefore, it is further preferred that the relationship between the refill drive signal application time ts and the refill time tA be a mode for satisfying the following formula (16):

$$ts = tA. \tag{16}$$

On the other hand, it is necessary to control the amount obtained when increasing the volume of the pressure chamber 52 at the time of drive signal application, in order not to eject the ink when operating the actuator 58 in the pushing direction after refill to return the pressure chamber 52 to its initial state.

The allowance of the volume variation of the pressure chamber 52 at the time of the refill drive signal application is smaller than the half the volume of a droplet having the same radius as $r_{n2}$ of the nozzle narrow-conduit portion 51B.

Hence, a volume variation ΔV of the pressure chamber 52 at the time of refill drive signal application satisfies the following inequality (17):

$$\Delta V \leqq \frac{2}{3}\cdot\pi\cdot r_{n2}^3. \tag{17}$$

An example of the volume variation ΔV of the pressure chamber 52 at the time of refill drive signal application for satisfying the condition expressed in the inequality (17) is such that ΔV is approximately 7 pl when the diameter $D_{n2}$ of the nozzle narrow-conduit portion 51B is 30 μm.

More specifically, the above condition indicates that, when the meniscus surface is formed on a formation surface of the nozzle opening portion 51A at the time of refill, and when the volume of the pressure chamber 52 is returned to the volume of its initial state, the ink is not ejected outside if the ink that flows outside of the formation surface of the nozzle opening portion 51A is half or less the droplet that has the same diameter as the diameter $D_{n2}$ of the nozzle narrow-conduit portion 51B.

The print head 50 equipped in the inkjet recording apparatus 10, which is configured as described above, operates the actuator 58 such that the pressure chamber 52 is expanded, after an ejection operation, more than its initial state before the ejection operation, and then is returned to the initial state of the pressure chamber 52 after a lapse of the refill drive signal application time ts. Therefore, the speed of refill can be increased using a force generated by the actuator 58 at the time of refill.

Moreover, the ink chamber units 53 of the print head 50 are configured so that the meniscus surface does not oscillate at the time of refill, thereby expanding the degree of freedom for the waveforms of the drive signals of the actuator used in refill without causing the meniscus surface to oscillate at the time of refill.

The above description illustrates an inkjet recording apparatus as an example of a liquid ejection apparatus. However, the applicable scope of the present invention is not limited to the above description, thus the present invention can be applied to various image forming apparatuses and liquid ejection apparatuses for ejecting liquid onto an ejection receiving medium to form a three-dimensional form on the ejection receiving medium.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection apparatus, comprising:

a liquid ejection head including:

a nozzle through which liquid is ejected, a pressure chamber which stores the liquid ejected through the nozzle, a pressurizing device which changes a volume of the pressure chamber to apply pressure to the liquid stored in the pressure chamber, and a supply port through which the liquid is supplied to the pressure chamber; and a drive controlling device which drives the pressurizing device so as to increase the volume of the pressure chamber more than the volume of an initial state thereof before starting an ejection operation for a predetermined period of time after the liquid is ejected through the nozzle, and to return the volume of the pressure chamber to the initial state after the predetermined period of time elapses, wherein the liquid ejection head has a structure such that inertance Mn of the nozzle, liquid resistance Rn of the nozzle, compliance Cn caused by a surface tension of the liquid in the nozzle, inertance Ms of the supply port, and liquid resistance Rs of the supply port satisfy the following inequality:

$$\frac{4\cdot(Mn+Ms)}{Cn} \leqq (Rn+Rs)^2,$$

so that oscillation of a meniscus surface located in vicinity of the nozzle is controlled at a time of refill when the liquid is filled in the pressure chamber through the supply port after the liquid is ejected from the nozzle, the pressurizing device is responsive to a voltage level of a drive signal, at the end of the ejection operation, the voltage level of the drive signal immediately changes to a voltage level, different from the voltage level at the end of the ejection operation, at which an operation to return the volume of the pressure chamber to the initial state begins, the liquid has a viscosity of at least $5.5\times10^{-3}$ Pa·s, and a volume ΔV which is obtained when increasing the volume of the pressure chamber from the initial state thereof before starting the ejection operation for the predetermined period of time after the liquid is ejected through the nozzle, satisfies the following inequality:

$$\Delta V \leqq \frac{2}{3}\cdot\pi\cdot r^3,$$

where r is a radius of the nozzle.

2. A liquid ejection apparatus, comprising:

a liquid ejection head including:

a nozzle through which liquid is ejected, a pressure chamber which stores the liquid ejected through the nozzle, a pressurizing device which changes a volume of the pressure chamber to apply pressure to the liquid stored in the pressure chamber, and a supply port through which the liquid is supplied to the pressure chamber; and a drive controlling device which drives the pressurizing device so as to increase the volume of the pressure chamber more than the volume of an initial state thereof before starting an ejection operation for a predetermined period of time after the liquid is ejected through the nozzle, and to return the volume of the pressure chamber to the initial state after the predetermined period of time elapses, wherein the liquid ejection head has a structure such that inertance Mn of the nozzle, liquid resistance Rn of the nozzle, compliance Cn caused by a surface tension of the liquid in the nozzle, inertance Ms of the supply port, and liquid resistance Rs of the supply port satisfy the following inequality:

$$\frac{4\cdot(Mn+Ms)}{Cn} \leq (Rn+Rs)^2,$$

so that oscillation of a meniscus surface located in vicinity of the nozzle is controlled at a time of refill when the liquid is filled in the pressure chamber though the supply port after the liquid is ejected from the nozzle, the pressurizing device is responsive to a voltage level of a drive signal, at the end of the ejection operation, the voltage level of the drive signal immediately changes to a voltage level, different from the voltage level at the end of the ejection operation, at which an operation to return the volume of the pressure chamber to the initial state begins, the liquid has a viscosity of at least $5.5\times10^{-3}$ Pa·s, the predetermined period of time after the liquid is ejected is set to a period of time in which to refill the pressure chamber with the liquid in such a manner that a volume of the liquid with which the pressure chamber is refilled becomes practically a volume of the liquid ejected though the nozzle during one ejection operation, and taking tA to be the predetermined period of time after the liquid is ejected, taking A to be the volume of the liquid ejected though the nozzle during one ejection operation, taking B to be a differential between the volume of the volume of the initial state of the pressure chamber before starting the ejection operation and the volume of the pressure chamber which is increased more than the volume of the initial state thereof after the liquid is ejected though the nozzle, taking x(t) to be a displacement volume of the liquid on a nozzle surface, then $$\alpha = \frac{R_n+R_s}{M_n+M_s} - \sqrt{\left(\frac{R_n+R_s}{M_n+M_s}\right)^2 - \left(\frac{4}{(M_n+M_s)\cdot C_n}\right)},$$

$$\beta = \frac{R_n+R_s}{M_n+M_s} + \sqrt{\left(\frac{R_n+R_s}{M_n+M_s}\right)^2 - \left(\frac{4}{(M_n+M_s)\cdot C_n}\right)},$$

$$x = \frac{F}{\sqrt{C_n^2\cdot(R_n+R_s)^2 - 4\cdot(M_n+M_s)\cdot C_n}}\cdot\left(\frac{\exp\left(-\frac{1}{2}\cdot\alpha\cdot t\right)}{-\frac{1}{2}\cdot\alpha} - \frac{\exp\left(-\frac{1}{2}\cdot\beta\cdot t\right)}{-\frac{1}{2}\cdot\beta}\right),$$

where F is the amount of the ink filled into the pressure chamber at the time of refill, and $$x(t=tA)/x(t=0) = \frac{A}{A+B} = \frac{\alpha\cdot\exp\left(\frac{1}{2}\cdot\beta\cdot tA\right) - \beta\cdot\exp\left(\frac{1}{2}\cdot\alpha\cdot tA\right)}{\alpha-\beta}.$$

* * * * *